US011492867B2

(12) United States Patent
Yuan et al.

(10) Patent No.: US 11,492,867 B2
(45) Date of Patent: Nov. 8, 2022

(54) DOWNHOLE APPARATUS WITH DEGRADABLE PLUGS

(71) Applicant: Halliburton Energy Services, Inc., Houston, TX (US)

(72) Inventors: Min Mark Yuan, Katy, TX (US); Frank Vinicio Acosta, Spring, TX (US); Lonnie C. Helms, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 161 days.

(21) Appl. No.: 16/640,217

(22) PCT Filed: Apr. 16, 2019

(86) PCT No.: PCT/US2019/027625
§ 371 (c)(1),
(2) Date: Feb. 19, 2020

(87) PCT Pub. No.: WO2020/214154
PCT Pub. Date: Oct. 22, 2020

(65) Prior Publication Data
US 2021/0140262 A1 May 13, 2021

(51) Int. Cl.
*E21B 33/12* (2006.01)

(52) U.S. Cl.
CPC ..... *E21B 33/12* (2013.01); *E21B 2200/08* (2020.05)

(58) Field of Classification Search
CPC ..... E21B 33/12; E21B 2200/08; E21B 17/06; E21B 34/06
See application file for complete search history.

(56) References Cited

U.S. PATENT DOCUMENTS

| | | | |
|---|---|---|---|
| 3,463,351 | A | 8/1969 | Mills |
| 3,779,263 | A | 12/1973 | Edwards et al. |
| 3,980,134 | A | 9/1976 | Amancharla |
| 4,457,376 | A | 7/1984 | Carmody et al. |
| 5,150,756 | A | 9/1992 | Hassanzadeh |

(Continued)

FOREIGN PATENT DOCUMENTS

| | | | |
|---|---|---|---|
| EP | 0566290 | A1 | 10/1993 |
| EP | 0681087 | B1 | 9/2000 |

(Continued)

OTHER PUBLICATIONS

International Search Report and Written Opinion dated Jan. 16, 2020, issued in corresponding PCT Application No. PCT/US2019/027625.

(Continued)

*Primary Examiner* — Abby J Flynn
*Assistant Examiner* — Yanick A Akaragwe
(74) *Attorney, Agent, or Firm* — McAfee & Taft

(57) ABSTRACT

A downhole apparatus includes an outer case connectable at upper and lower ends thereof in a casing string. A degradable plug is fixed in an interior of the outer case. A rupture disc is mounted in a port in the wall of the outer case. The port is positioned to communicate a degrading fluid to an axial flow passage defined in a wall of the outer case and the axial flow passage is configured to communicate the degrading fluid back into the interior of the outer case and into the degradable plug.

13 Claims, 7 Drawing Sheets

(56) References Cited

U.S. PATENT DOCUMENTS

| | | | | |
|---|---|---|---|---|
| 5,479,986 | A | 1/1996 | Gano et al. | |
| 5,765,641 | A | 6/1998 | Shy et al. | |
| 5,826,661 | A | 10/1998 | Parker et al. | |
| 6,026,903 | A | 2/2000 | Shy et al. | |
| 6,076,600 | A | 6/2000 | Vick, Jr. et al. | |
| 6,161,622 | A | 12/2000 | Robb et al. | |
| 6,324,904 | B1 | 12/2001 | Ishikawa et al. | |
| 6,450,263 | B1 | 9/2002 | Schwendemann | |
| 6,505,621 | B2 | 1/2003 | Gabelmann et al. | |
| 6,505,685 | B1 | 1/2003 | Sullaway et al. | |
| 6,622,798 | B1 | 9/2003 | Rogers et al. | |
| 6,651,748 | B2 | 11/2003 | Sullaway et al. | |
| 6,672,389 | B1 | 1/2004 | Hinrichs | |
| 6,758,281 | B2 | 7/2004 | Sullaway et al. | |
| 7,270,191 | B2 | 9/2007 | Drummond et al. | |
| 9,033,055 | B2 | 5/2015 | Mccoy et al. | |
| 9,222,322 | B2 * | 12/2015 | Brandsdal | E21B 33/12 |
| 9,291,031 | B2 * | 3/2016 | Frazier | E21B 34/10 |
| 9,309,752 | B2 | 4/2016 | Talley et al. | |
| 9,441,437 | B2 | 9/2016 | Fripp et al. | |
| 9,441,446 | B2 | 9/2016 | Fripp et al. | |
| 9,518,445 | B2 | 12/2016 | Noske | |
| 9,540,904 | B2 | 1/2017 | Petrowsky | |
| 9,593,542 | B2 | 3/2017 | Getzlaf et al. | |
| 10,138,707 | B2 | 11/2018 | Tolman et al. | |
| 10,323,478 | B2 | 6/2019 | Berscheidt et al. | |
| 2002/0185273 | A1 | 12/2002 | Aronstam et al. | |
| 2003/0116324 | A1 | 6/2003 | Dawson et al. | |
| 2003/0217844 | A1 | 11/2003 | Moyes | |
| 2008/0073075 | A1 | 3/2008 | Buyers et al. | |
| 2008/0115942 | A1 | 5/2008 | Keller et al. | |
| 2010/0270031 | A1 * | 10/2010 | Patel | E21B 33/1208 166/376 |
| 2010/0294376 | A1 | 11/2010 | O'Brien et al. | |
| 2011/0042099 | A1 | 2/2011 | Williamson, Jr. et al. | |
| 2011/0253392 | A1 | 10/2011 | May et al. | |
| 2012/0111566 | A1 | 5/2012 | Sherman et al. | |
| 2014/0174757 | A1 | 6/2014 | Fripp et al. | |
| 2014/0216756 | A1 | 8/2014 | Getzlaf et al. | |
| 2014/0224505 | A1 | 8/2014 | Ramon | |
| 2014/0338923 | A1 | 11/2014 | Fripp et al. | |
| 2015/0107843 | A1 | 4/2015 | Talley et al. | |
| 2015/0129205 | A1 | 5/2015 | Hofman et al. | |
| 2015/0240596 | A1 | 8/2015 | Horwell | |
| 2016/0177668 | A1 | 6/2016 | Watson et al. | |
| 2016/0333658 | A1 | 11/2016 | Keshishian et al. | |
| 2017/0096875 | A1 | 4/2017 | Ravensbergen et al. | |
| 2017/0138153 | A1 | 5/2017 | Getzlaf et al. | |
| 2018/0003004 | A1 | 1/2018 | Norman et al. | |
| 2018/0058179 | A1 | 3/2018 | Nuryaningsih et al. | |
| 2018/0080308 | A1 | 3/2018 | Dedman et al. | |
| 2018/0219200 | A1 | 8/2018 | Albukrek et al. | |
| 2018/0262127 | A1 | 9/2018 | Gooneratne et al. | |
| 2018/0371869 | A1 | 12/2018 | Kellner et al. | |
| 2019/0128081 | A1 | 5/2019 | Ross et al. | |
| 2019/0352994 | A1 | 11/2019 | Giroux | |
| 2019/0352995 | A1 | 11/2019 | Giroux et al. | |

FOREIGN PATENT DOCUMENTS

| | | | |
|---|---|---|---|
| JP | 6551001 | B2 | 7/2019 |
| WO | 2014098903 | A1 | 6/2014 |
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Jul. 21, 2020, issued in PCT Application No. PCT/US2019/059864.
International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.
International Search Report and Written Opinion dated Oct. 27, 2020, issued in PCT Application No. PCT/US2020/039399.
International Search Report and Written Opinion dated Feb. 24, 2021, issued in PCT Application No. PCT/US2020/040157.
International Search Report and Written Opinion dated Aug. 14, 2018, issued in PCT Application No. PCT/US2017/062528.
International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Aug. 14, 2019, issued in PCT Application No. PCT/US2019/064051.
International Search Report and Written Opinion dated Jan. 14, 2020, issued in PCT Application No. PCT/US2019/027502.
International Search Report and Written Opinion dated Feb. 5, 2020, issued in PCT Application No. PCT/US2019/0031541.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application No. PCT/US2019/059757.

* cited by examiner

DOWNHOLE APPARATUS WITH DEGRADABLE PLUGS

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

BRIEF DESCRIPTION OF THE DRAWINGS

FIG. 3 is a cross section of an additional embodiment of a downhole apparatus.

FIG. 6 is a cross section of the embodiment of FIG. 4 after the plug therein has degraded.

DESCRIPTION

Figure 1:
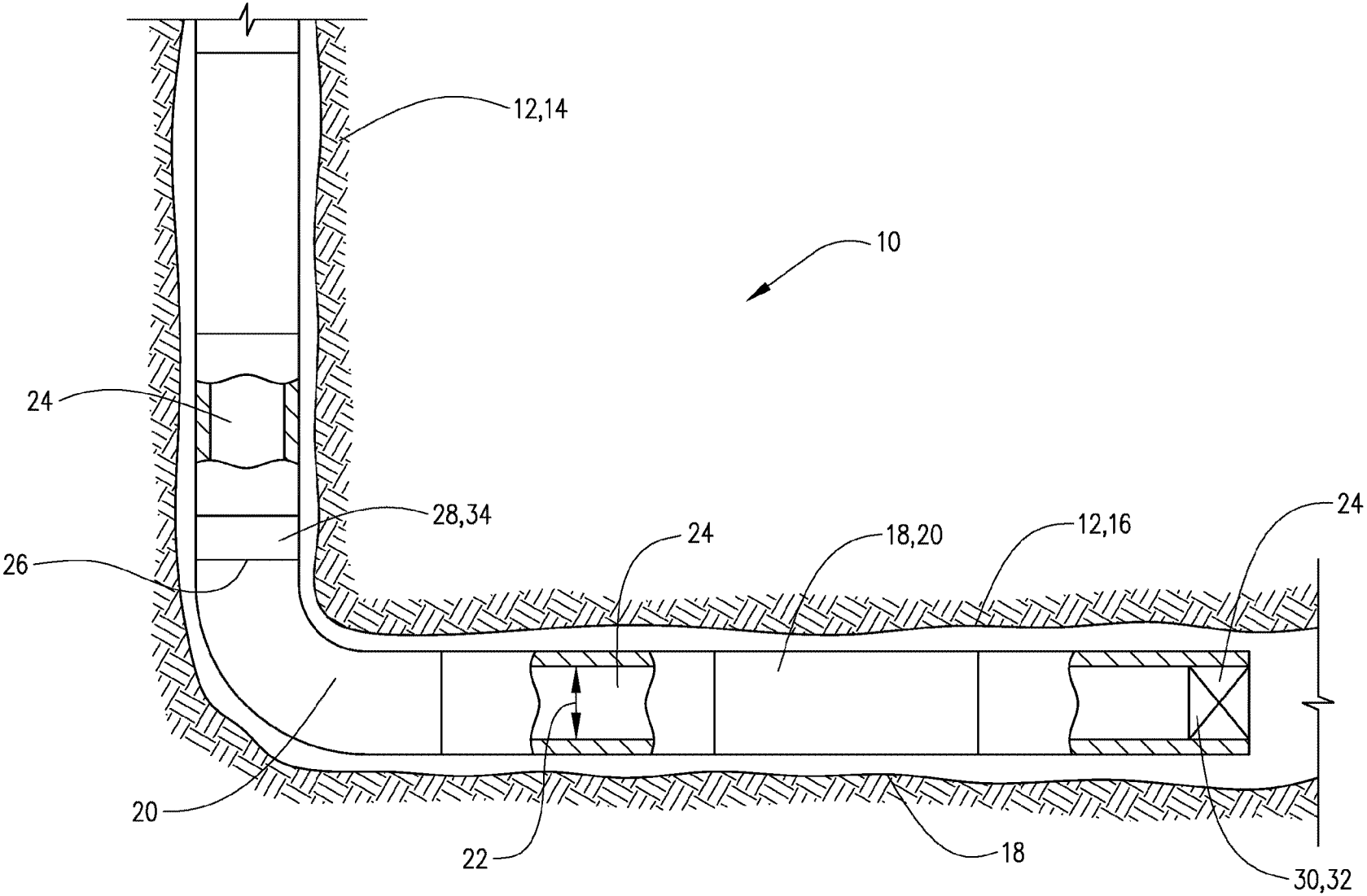
FIG. 1 is a schematic view of an exemplary well bore with a well casing including a buoyancy chamber therein.
Figure 2:
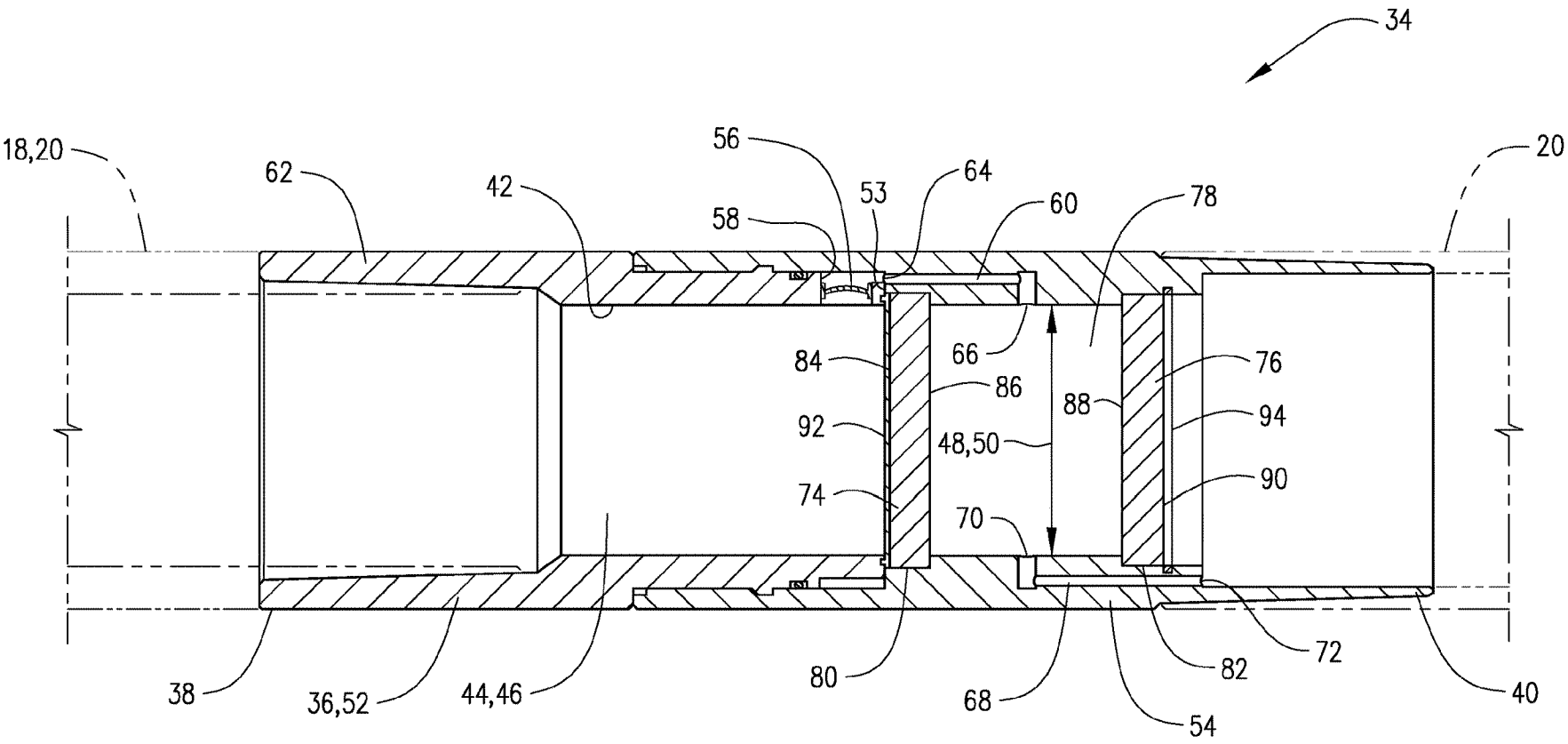
FIG. 2 is a cross section of a downhole apparatus of the current disclosure.
Figure 5:
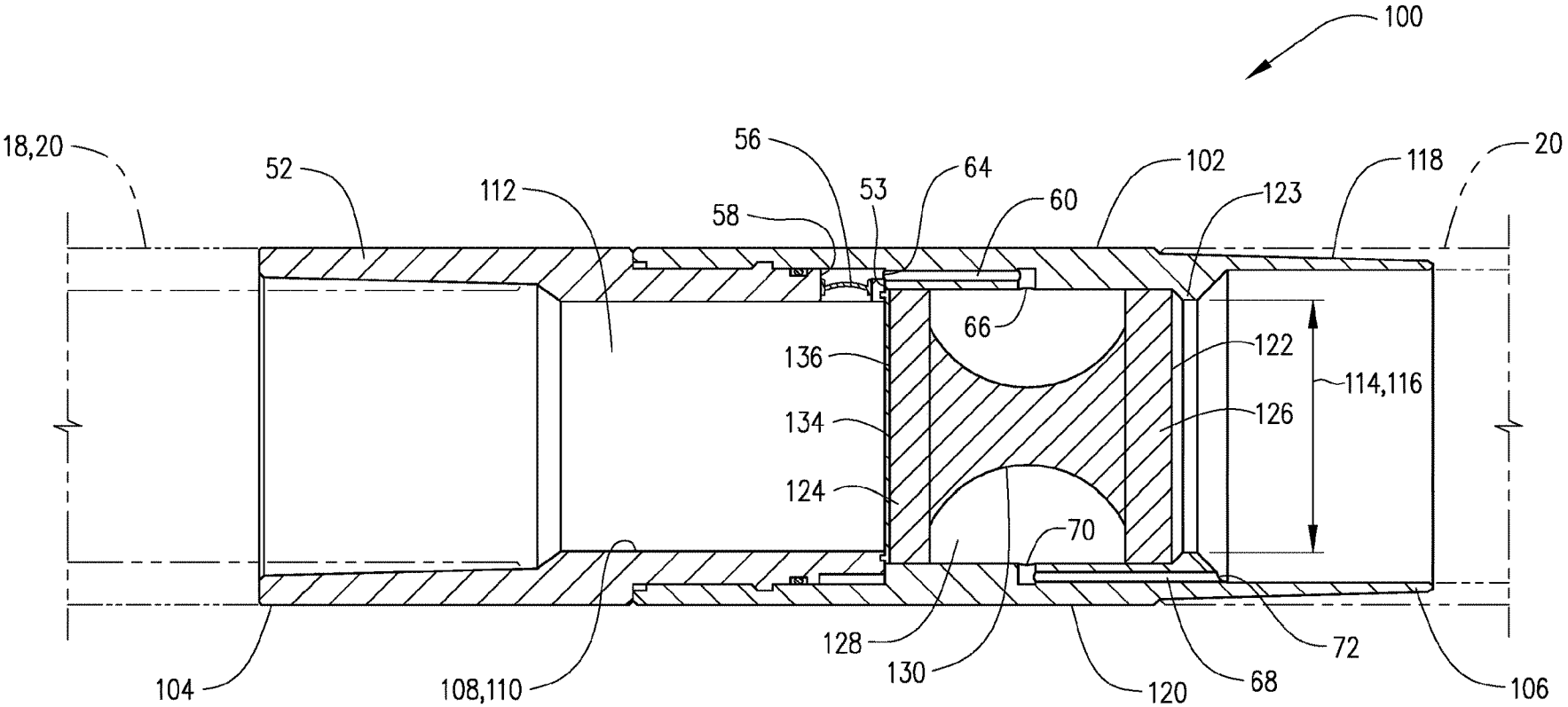
FIG. 5 is a cross section of the embodiments of FIG. 3 after the plugs therein have degraded.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these are used is a factor of the well conditions and the amount of buoyancy desired.

Lower boundary 30 may comprise a float device such as a float shoe or float collar. As is known, such float devices will generally allow fluid flow downwardly therethrough but will prevent flow upwardly into the casing. The float devices are generally a one-way check valve. The float device 30 will be configured such that it will hold the buoyant fluid in the buoyancy chamber 26 until additional pressure is applied after the release of the buoyancy fluid from the buoyancy chamber.

The upper boundary 28 is defined by a buoyancy assist tool 34. Buoyancy assist tool 34 comprises an outer case 36 with upper and lower ends 38 and 40 connected to casing joints 20 thereabove and therebelow. Thus, outer case 36 defines a portion of casing string 18. Outer case 36 has an inner surface 42 defining a flow path 44 therethrough. Inner surface 42 likewise defines interior 46 of outer case 36. Inner surface 42 defines inner diameter 48 which may include a minimum inner diameter 50.

Outer case 36 may comprise an upper portion or upper outer case 52 and a lower portion or lower outer case 54. Upper outer case 52 has lower end 53. Upper and lower outer cases 52 and 54 may be threadedly connected to one another. A rupture disk 56 is positioned in a port 58. Port 58 is defined in a wall 62 or outer case 36, and in the embodiment described, port 58 is defined in wall 62 in upper outer case 52. Rupture disk 56 may be of a type known in the art that will rupture or burst at a predetermined application of pressure. Once rupture disk 56 is ruptured, fluid flowing through upper outer case 52 which is fluid flowing through casing 18 will be communicated through port 58.

An axial flow passage 60, which may be referred to as first axial flow passage 60, is defined in wall 62 of outer case 36. In the embodiment described first axial flow passage 60 is defined in wall 62 in lower outer case 54. First axial flow passage 60 has upper or entry opening 64 and a lower or exit opening 66. A second axial flow passage 68 is defined in wall 62. Second axial flow passage 68 has an entry opening 70 and a lower or exit opening 72. In the embodiment shown second axial flow passage 68 is defined in lower outer case 54.

Buoyancy assist tool 34 includes at least one degradable plug therein and in the embodiment described has an upper or first degradable plug 74 and a lower or second degradable plug 76. First and second degradable plugs 74 and 76 are spaced apart longitudinally from one another and define space 78 therebetween. Upper and lower degradable plugs 74 and 76 may be mounted in upper and lower grooves 80 and 82 defined in outer case 36.

Upper degradable plug 74 has upper surface 84 and bottom surface 86. Lower degradable plug 76 has upper surface 88 and lower surface 90. A non-permeable seal or coating 92 is a non-structural coating that covers upper surface 84 of upper degradable plug 74. Seal 92 will prevent a fluid passing downward in casing 18 from prematurely acting on the degradable plug 74 to begin the degradation or dissolving process. A lock ring 94 in outer case 36 supports lower degradable plug 76.

In operation casing string 18 with buoyancy chamber 26 and buoyancy assist tool 34, which is the upper end or upper boundary of buoyancy chamber 26, is lowered in the well bore to the desired location. Running a casing such as casing string 18 in deviated wells and along horizontal wells often results in significantly increased drag forces and may cause a casing string to become stuck before reaching the desired location in the well bore. For example, when the casing string 18 produces more drag forces than any available weight to slide the casing string 18 down the well the casing string may become stuck. If too much force is applied damage may occur to the casing string. The buoyancy assist tool 34 described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into well bore 12 buoyancy chamber 26 will aid in the proper placement since it will reduce friction as the casing 18 is lowered into the horizontal portion 16 to the desired location.

Once the desired depth is reached in well bore 12, fluid pressure in casing string 18 is increased to a predetermined pressure at which the rupture disk 56 will burst. After rupture disk 56 ruptures fluid passing downward through casing 18 will be communicated into first axial flow passage 60. The fluid, which will be a degrading fluid used to degrade first and second degradable plugs 74 and 76 will be communicated from the interior 46 of casing 18 defined by outer case 36 into the entry opening 64 of first axial flow passage 60. Fluid will pass through axial flow passage 60 and pass through exit opening 66 back into the interior 46. In the embodiment shown fluid passes from first axial flow passage 60 back into interior 46 in the interior space 78 between upper and lower degradable plugs 74 and 76 respectively. Fluid passing therein will begin to act on bottom surface 84 of upper degradable plug 74 and the upper surface 88 of the lower degradable plug 76. Fluid will circulate through the interior space 78 and will pass out of the interior space 78 into second axial flow passage 68.

Fluid will pass from the interior space 78 between the upper and lower degradable plugs 74 and 76 into the entry opening 70 of second axial flow passage 68. Fluid will be communicated back into the interior 46 below second degradable plug 76 through exit opening 72. The flow of fluid in interior space 78 will allow sufficient contact with the degradable plugs 74 and 76 such that both will begin to dissolve. As degradable plugs 74 and 76 dissolve fluid passing downward through casing 18 will continue to be passed into first axial flow passage 60 and will continue to act on the upper and lower degradable plugs 74 and 76. Ultimately plugs 74 and 76 will degrade sufficiently such that the fluid will break through the first degradable plug 74 and the second degradable plug 76. Both of the first and second degradable plugs 74 and 76 will be completely degraded such that there is an open bore through buoyancy assist tool 34. The buoyancy assist tool 34 thus provides no greater restriction than the minimum diameter of the casing which may be for example identical to or slightly smaller than minimum diameter 50. In any event buoyancy assist tool 34 defines the upper boundary of buoyancy chamber 26, and provides no restriction on the size of tools that can pass therethrough that did not already exist as a result of the inner diameter of the casing string 18.

An alternative embodiment for a buoyancy assist tool is shown in FIG. 3. Buoyancy assist tool 100, like buoyancy assist tool 34, may be connected in and form a part of the casing string 18 lowered into a well. Buoyancy assist tool 100 has an outer case 102. Outer case 102 is similar in many respects to outer case 36 in that the upper outer case is the same as and is marked as upper outer case 52.

Outer case 102 has upper end 104, lower end 106, inner surface 108, and longitudinal central flow passage 110. Upper and lower ends 104 and 106 are adapted to be connected in casing string 18. Inner surface 108 defines an interior 112. Interior 112 has inner diameter 114 which will include a minimum inner diameter 116. Outer case 102 includes upper outer case 52 threadedly connected to lower outer case 118.

Outer case 102 includes an outer wall 120 in which first and second axial flow passages 60 and 68 are defined. Rupture disk 56 is positioned in a port 58 in outer case 102 and as in the embodiment described in upper outer case 52. A degradable plug 122 is mounted in outer case 102. Plug 122 may be held in place by a lower end 53 of upper outer case 52 and an upward facing shoulder 123 on lower outer case 118. Degradable plug 122 may comprise an upper cap portion 124 and a lower cap portion 126 spaced longitudinally therefrom. Upper and lower cap portions 124 and 126 define a space 128 therebetween which forms a part of the interior 112 of outer case 102.

A connecting portion 130 of degradable plug 122 connects upper and lower cap portions 124 and 126 respectively. Connecting portion 130 is shaped such that it does not fill space 128, to provide for fluid flow into and through the space 128 between upper and lower cap portions 124 and 126. In the embodiment shown the connecting portion is shaped like a hyperbolic hyperboloid. A non-permeable seal or coating 134 covers an upper surface 136 of upper cap portion 124. A coating or sealant may be used on a lower surface 138 of lower cap portion 126 as well.

In operation casing string 18 with buoyancy chamber 26 and buoyancy assist tool 100, which is the upper end or upper boundary of buoyancy chamber 26, is lowered in the well bore to the desired location. Running a casing such as casing string 18 in deviated wells and along horizontal wells often results in significantly increased drag forces and may cause a casing string to become stuck before reaching the desired location in the well bore. For example, when the casing string 18 produces more drag forces than any available weight to slide the casing string 18 down the well the casing string may become stuck. If too much force is applied damage may occur to the casing string. The buoyancy assist tool 100 described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into well bore 12 buoyancy chamber 26 will aid in the proper placement since it will reduce friction as the casing 18 is lowered into the horizontal portion 16 to the desired location.

Once the desired depth is reached in well bore 12, fluid pressure in casing string 18 is increased to a predetermined pressure at which the rupture disk 56 will burst. After rupture disk 56 ruptures fluid passing downward through casing 18 will be communicated into first axial flow passage 60. The fluid, which will be a degrading fluid used to degrade degradable plug 122 will be communicated from the interior 112 of casing 18 defined by outer case 102 into the entry opening 64 of first axial flow passage 66. Fluid will pass through axial flow passage 60 and pass through exit opening 60 back into the interior 46. In the embodiment shown fluid passes from first axial flow passage 60 back into interior 46 in the interior space 128 between upper and lower cap portions 124 and 126 respectively. Fluid passing therein will begin to act on degradable plug 122. Fluid will circulate through the interior space 128 and will pass out of the interior space 128 into second axial flow passage 68.

Fluid will pass from the interior space 128 between the upper and lower cap portions 124 and 126 into the entry opening 70 of second axial flow passage 68. Fluid will be communicated back into the interior 112 below lower cap portion 126. The flow of fluid in interior space 128 will allow sufficient contact with the degradable plug 122 such that the plug will begin to dissolve. As degradable plug 122 dissolves fluid passing downward through casing 18 will continue to be passed into first axial flow passage 60 and will continue to act on the plug 122. Ultimately plug 122 will degrade sufficiently such that the fluid will break through the upper cap portion 124. Ultimately the plug 122 will completely dissolve such that there is an open bore through buoyancy assist tool 100. The buoyancy assist tool 100 thus provides no greater restriction than the minimum diameter of the casing which may be for example identical to or slightly smaller than minimum diameter 116. In any event buoyancy assist tool 100 defines the upper boundary of buoyancy chamber 26, and provides no restriction on the size of tools that can pass therethrough that did not already exist as a result of the inner diameter of the casing string 18.

Figure 4:
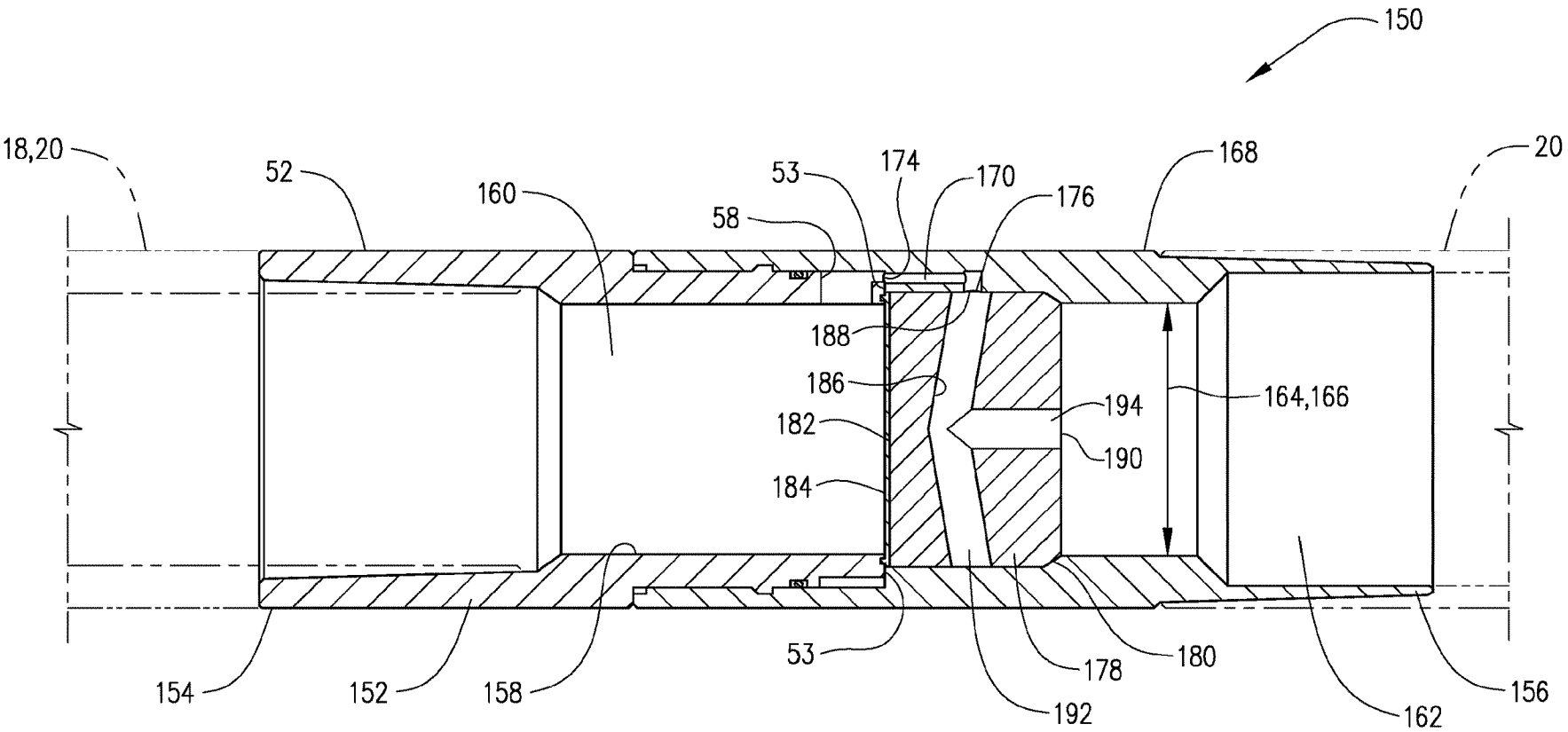
FIG. 4 is cross section of another alternative embodiment of a downhole apparatus.
Figure 5:
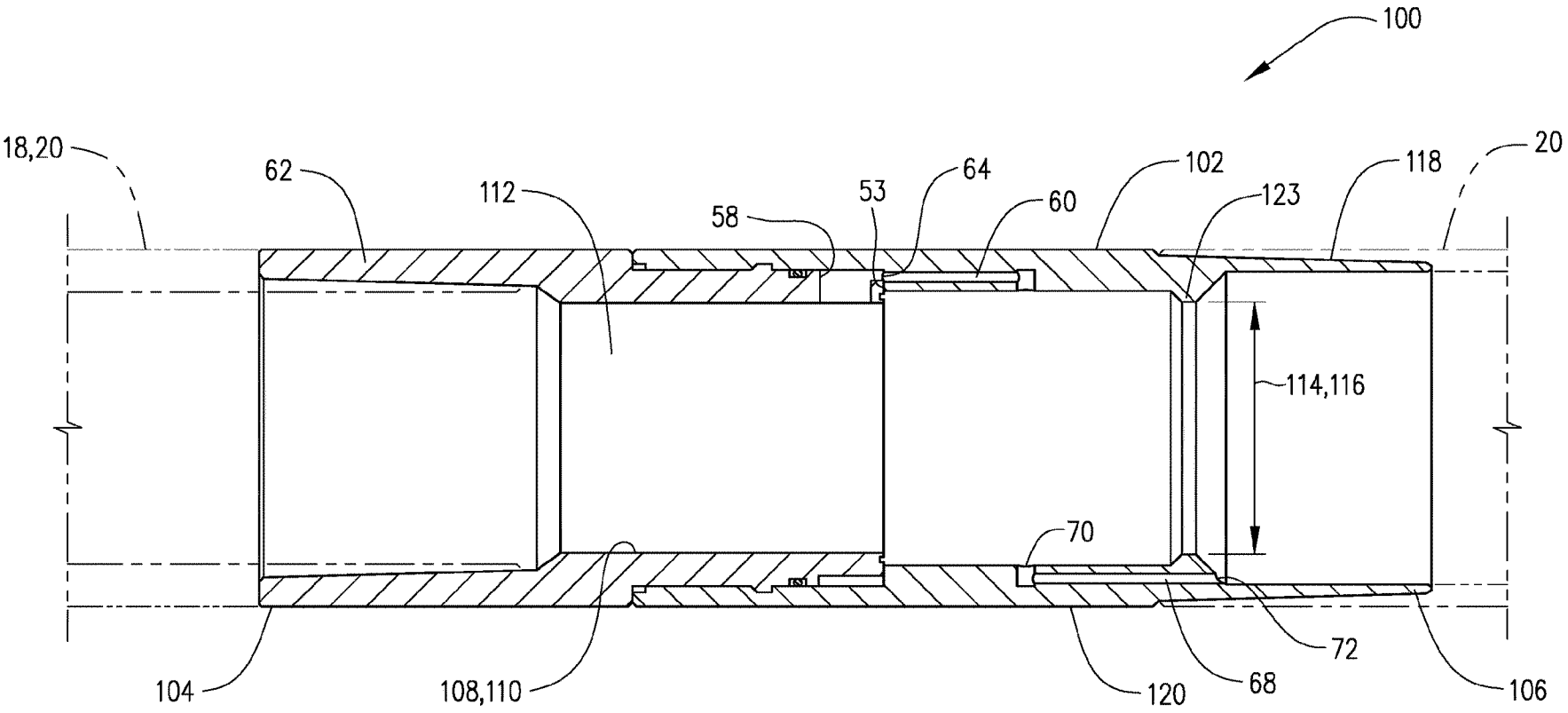
Figure 5:
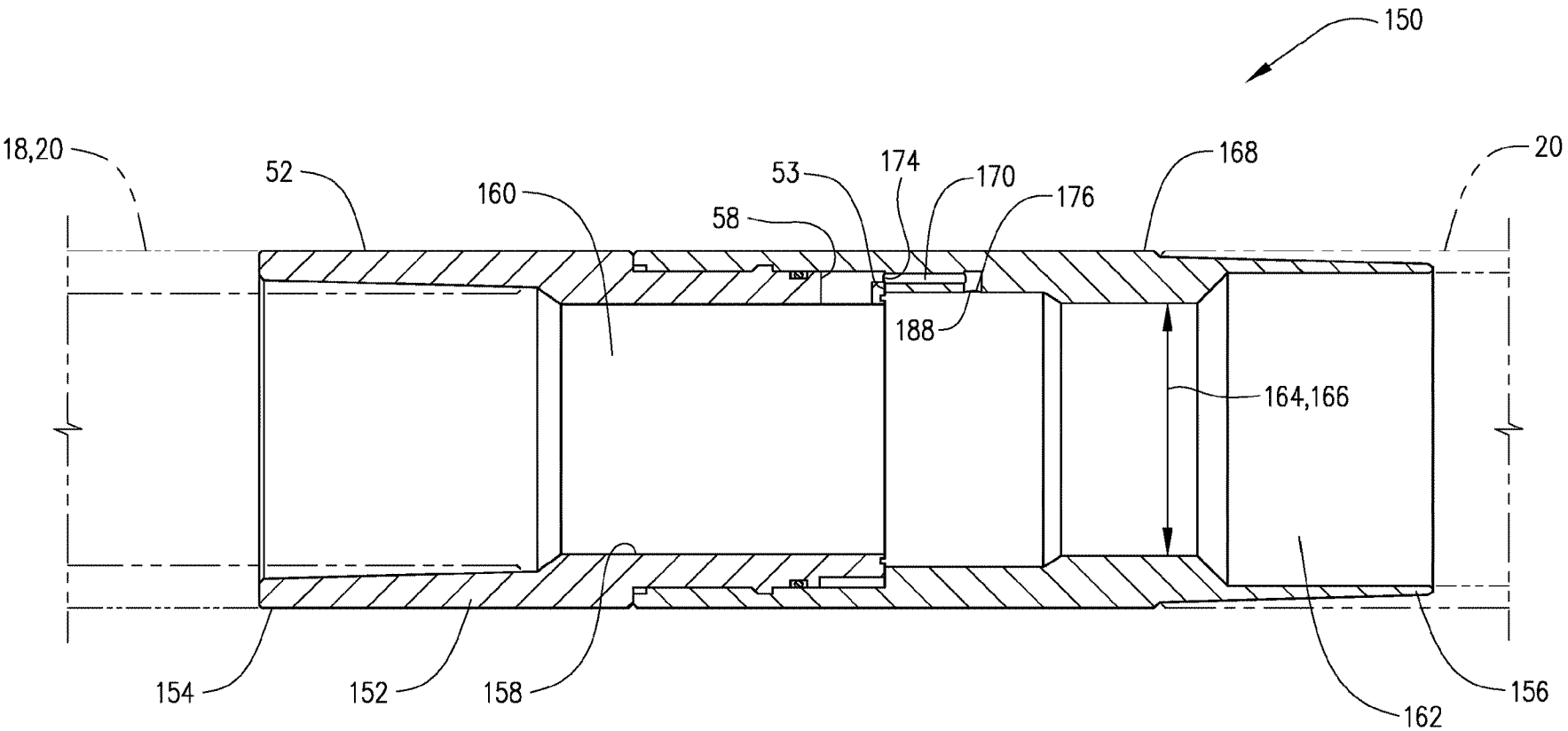
Figure 7:
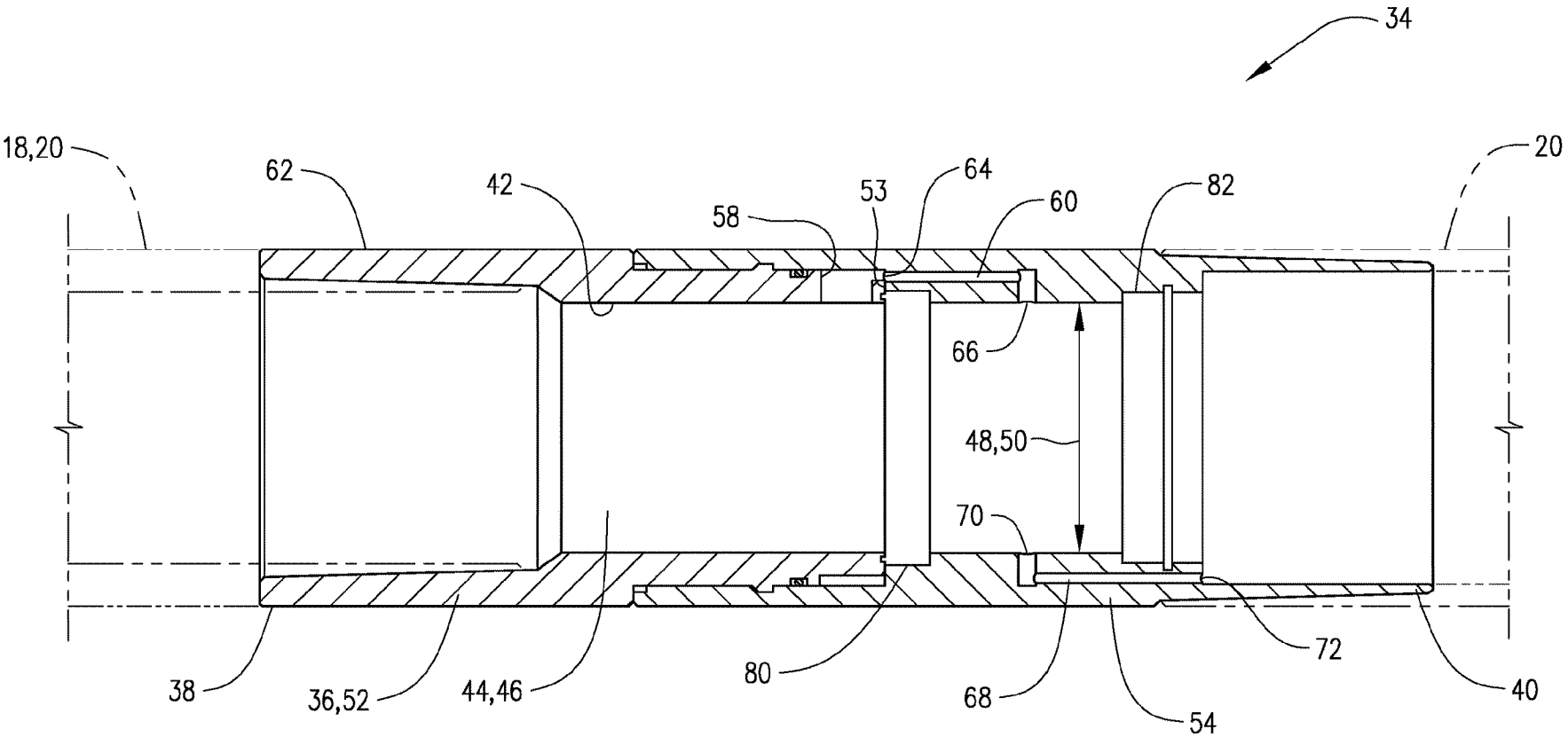
FIG. 7 is a cross section of the embodiment of FIG. 2 after the plug therein has degraded.

A third embodiment of buoyancy assist tool 150 is shown in FIG. 4. Buoyancy assist tool 150 may be connected in a casing string 18 as described herein. Buoyancy assist tool 150 has an outer case 152 with upper and lower ends 154 and 156 configured to be connected into casing string 18. Thus, outer case 152 will comprise a portion of casing string 18. Outer case 152 defines inner surface 158 and longitudinal flow passage 160 therethrough. Inner surface 158 defines an interior 162 of outer case 152. Inner surface 158 defines an inner diameter 164 which may define minimum inner diameter 166.

Outer case 152 comprises upper outer case 52 as previously described herein threadedly connected to a lower outer case 168. An axial flow passage 170 is defined in a wall 172 of outer case 152. Axial flow passage 170 is defined in wall 172 in the lower outer case 168. Axial flow passage 170 has an entry end 174 and an exit end 176.

A degradable plug 178 is mounted in outer case 152 and is configured to block flow therethrough. Plug 178 is mounted in outer case 152 and may be positioned between an upward facing shoulder 180 defined on inner surface 158 and the lower end 53 of upper outer case 52. Degradable plug 178 has an upper surface 182. An impermeable coating or seal 184 prevents fluid passing downward through casing 18 from acting on the upper surface thereof to prematurely degrade or dissolve the degradable plug 178. A flow channel 186 is defined in degradable plug 178. Flow channel 186 has entry port 188 and has an exit port 190.

Fluid flowing downward in casing 18 will increase pressure to a predetermined pressure sufficient to burst rupture disk 56. Once rupture disk 56 ruptures fluid will pass into the entry end 174 of axial flow passage 170. The degrading fluid will exit axial flow passage 170 through exit opening 176 into flow channel 186. Flow channel 186 in plug 178 will receive fluid from axial flow passage 170 at the entry port 188 thereof. The degrading fluid will enter flow channel 186 and will exit through the exit port 190 thereof into the interior 162 of outer case 152 below degradable plug 178. Flow channel 186 in the embodiment shown includes a pathway 192 that spans outer case 152 and includes a connecting passage 194. Flow channel 186 is essentially a modified tee shape wherein the run of the tee is non linear. As degrading fluid continues to flow through flow channel 186 the degradable plug 178 will degrade sufficiently such that the fluid flow passing downwardly through the casing 18 will ultimately be sufficient to break up degradable plug 178 and create a completely open bore. The minimum inner diameter of outer case 152 is such that once the plug 178 is completely degraded it should not provide any greater restriction on the size of tools that can pass therethrough that did not exist with respect to the casing.

In operation casing string 18 with buoyancy chamber 26 and buoyancy assist tool 150, which is the upper end or upper boundary of buoyancy chamber 26, is lowered in the well bore to the desired location. Running a casing such as casing string 18 in deviated wells and along horizontal wells often results in significantly increased drag forces and may cause a casing string to become stuck before reaching the desired location in the well bore. For example, when the casing string 18 produces more drag forces than any available weight to slide the casing string 18 down the well the casing string may become stuck. If too much force is applied damage may occur to the casing string. The buoyancy assist tool 150 described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into well bore 12 buoyancy chamber 26 will aid in the proper placement since it will reduce friction as the casing 18 is lowered into the horizontal portion 16 to the desired location.

Once the desired depth is reached in well bore 12, fluid pressure in casing string 18 is increased to a predetermined pressure at which the rupture disk 56 will burst. After rupture disk 56 ruptures fluid passing downward through casing 18 will be communicated into axial flow passage 170. The fluid, which will be a degrading fluid used to degrade degradable plug 178 will be communicated from the interior 162 of casing 18 defined by outer case 152 into the entry opening 174 of axial flow passage 170. Fluid will pass through axial flow passage 170 into flow channel 186. Fluid will flow therethrough until degradable plug 178 breaks up sufficiently that fluid will begin to flow downwardly through outer case 152. Ultimately plug 178 will completely dissolve such that there is an open bore through buoyancy assist tool 150. The buoyancy assist tool 150 thus provides no greater restriction than the minimum diameter of the casing which may be for example identical to or slightly smaller than minimum diameter 166. In any event buoyancy assist tool 150 defines the upper boundary of buoyancy chamber 26, and provides no restriction on the size of tools that can pass therethrough that did not already exist as a result of the inner diameter of the casing string 18.

The degradable plugs may be comprised of a degradable material, which may be, in a non-limiting example, a degradable metallic material. There are a number of alloys, for example magnesium alloys known to be degradable with fluids pumped downhole, for example fresh water, salt water, brine, seawater or combinations thereof. Such alloys or other degradable materials may be used for the degradable plug.

A downhole apparatus of the current disclosure is a buoyancy assist tool. The buoyancy assist tool comprises an outer case connectable at upper and lower ends thereof in a casing string. The outer case defines an axial flow passage which may be referred to as a first axial flow passage in a wall thereof. A degradable plug is fixed in an interior of the outer case to block flow therethrough. A rupture disc is mounted in a port in the wall of the outer case and configured to rupture at a predetermined pressure. The port is positioned to communicate a degrading fluid to an entry end of the axial flow passage and an exit end of the axial flow passage is configured to communicate the degrading fluid back into with the interior of the outer case and direct fluid into the degradable plug.

In one embodiment the buoyancy assist tool comprises first and second spaced-apart degradable plugs mounted in the outer case. The exit end of the axial flow passage is configured to communicate the degrading fluid into the interior of the outer case between the first and second degradable plugs. The buoyancy assist tool may comprise first and second axial flow passages, with the second axial flow passage configured to receive degrading fluid from the space between the first and second degradable plugs and communicate the degrading fluid into the interior of the outer case below the second degradable plug.

In an additional embodiment the buoyancy assist tool comprises a generally cylindrical degradable plug defining a flow channel therethrough. The first axial flow passage is configured to communicate degrading fluid into the flow channel in the degradable plug. The flow channel in the degradable plug is configured to communicate degrading fluid through an opening in the lower end of the degradable plug.

In another embodiment the buoyancy assist tool includes a degradable plug with upper and lower cap portions defining a longitudinal space therebetween and a connecting portion extending between and connected to the upper and lower cap portions. The first axial flow passage is configured to communicate fluid into the space between the upper and lower cap portions. The connecting portion may be shaped like a hyperbolic hyperboloid.

An embodiment disclosed herein is a downhole apparatus comprising a casing string with a fluid barrier connected in the casing string defining a lower end of a buoyancy chamber. A first degradable plug is mounted in the casing string, and a rupture disc is mounted in a port in a wall of the casing string. The wall of the casing string has a first axial flow passage defined therein configured to receive fluid from an interior of the casing string above the first degradable plug and to deliver the degradable fluid back into the interior of the casing.

In one embodiment of the downhole apparatus the wall of the casing string has a second axial flow passage defined therein configured to receive and communicate fluid delivered into the interior of the casing string by the first axial flow passage back into the interior of the casing string. The downhole apparatus in one embodiment may include first and second spaced-apart degradable plugs in the casing string. The first axial flow passage may be configured to communicate degrading fluid into the interior of the casing string between the first and second degradable plugs, and the second axial flow passage configured to communicate the degrading fluid from the interior of the casing string between the degradable plugs to the interior of the casing string below the plugs. The first and second degradable plugs may comprise circular disks.

In one embodiment of the downhole apparatus the first degradable plug may comprise an upper cap portion, a lower cap portion spaced from the upper cap portion and a center connecting portion connecting the upper and lower cap portions. The first axial passage may be configured to communicate degrading fluid into the interior of the casing in the space between the upper and lower end cap portions. The second axial flow passage may be configured to communicate degrading fluid from the interior of the casing between the upper and lower cap portions to the interior below the lower cap portion. A non-permeable coating covers an upper surface of the degradable plug. A second axial flow passage is configured to communicate fluid delivered into the interior of the casing string by the first axial flow passage back into the interior of the casing string.

In one embodiment a casing string comprises a plurality of casing joints with a flow barrier positioned in the casing string defining a lower end of a buoyancy chamber. A plug assembly connected in the casing string defines an upper end of the buoyancy chamber. In an embodiment the plug assembly comprises an outer case connected in the casing string, wherein the outer case defines a first axial flow passage in a wall thereof. A degradable plug is mounted in the outer case. A rupture disk is mounted in a port in a wall of the outer case. The port is configured to communicate an interior of the casing above the degradable plug with the first axial flow passage, and the first axial flow passage is configured to communicate degrading fluid received from the port back into the interior of the casing to contact and degrade the degradable plug.

The outer case may have a second axial flow passage defined therein and the plug assembly may comprise first and second spaced-apart degradable plugs. The first axial passage is configured to deliver degrading fluid to the interior of the casing string between the first and second degradable plugs, and the second axial passage is configured to receive degrading fluid from the interior of the casing string between the first and second degradable plugs to the interior of the casing string below the second degradable plug.

In one embodiment of the casing string the degradable plug may comprise spaced-apart upper and lower cap portions and a connecting portion therebetween. The first axial passage may be configured to communicate fluid from an interior of the casing string above the upper cap portion to the interior of the casing string in the space between the upper and lower cap portions.

In an additional embodiment of the casing string the degradable plug defines a flow channel therein, and the first axial passage is configured to communicate fluid from the interior of the casing string above the degradable plug to the interior of the casing below the degradable plug through the flow channel.

Although the disclosed invention has been shown and described in detail with respect to a preferred embodiment, it will be understood by those skilled in the art that various changes in the form and detailed area may be made without departing from the spirit and scope of this invention as claimed. Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A downhole apparatus comprising:

an outer case connectable at upper and lower ends thereof in a casing string, the outer case defining a first axial flow passage in a wall thereof;

first and second spaced-apart degradable plugs mounted in the outer case to block flow therethrough;

a non-permeable seal positioned on an upper surface of the first degradable plug;

a rupture disc mounted in a port in the wall of the outer case and configured to rupture at a predetermined pressure, the port positioned to communicate a degrading fluid to an entry end of the first axial flow passage, an exit end of the first axial flow passage configured to communicate the degrading fluid back into the interior of the outer case between the first and second degradable plugs; and a second axial flow passage defined in the wall of the outer case and configured to receive degrading fluid from the space between the first and second degradable plugs and communicate the degrading fluid into the interior of the outer case below the second degradable plug.

2. The downhole apparatus of claim 1, the first and second degradable plugs comprising circular disks.

3. A downhole apparatus comprising:

a casing string;

a fluid barrier connected in the casing string defining a lower end of a buoyancy chamber;

a first degradable plug mounted in the casing string above the fluid barrier; and a rupture disc mounted in a port in a wall of the casing string, the wall of the casing string having a first axial flow passage defined therein configured to receive fluid from an interior of the casing string above the degradable plug and to deliver the degradable fluid back into the interior of the casing string, the casing string having a second axial flow passage defined in the wall thereof configured to receive the fluid delivered into the interior of the casing string by the first axial flow passage and communicate the fluid back into the interior of the casing string.

4. The downhole apparatus of claim 3, further comprising:

a second degradable plug spaced from the first degradable plug, the first axial flow passage configured to communicate degrading fluid into the interior of the casing string between the first and second degradable plugs, and the second axial flow passage configured to communicate the degrading fluid from the interior of the casing string between the degradable plugs to the interior of the casing string below the second degradable plug.

5. The downhole apparatus of claim 4, the first and second degradable plugs comprising circular disks.

6. The downhole apparatus of claim 3, the first degradable plug comprising:

an upper cap portion;

a lower cap portion spaced from the upper cap portion; and a center connecting portion connecting the upper and lower cap portions, the first axial passage configured to communicate degrading fluid into the interior of the casing string in the space between the upper and lower cap portions.

7. The downhole apparatus of claim 6, the second axial flow passage configured to communicate degrading fluid from the interior of the casing between the upper and lower cap portions to the interior below the lower cap portion.

8. The downhole apparatus of claim 3, further comprising a non-permeable coating covering an upper surface of the degradable plug.

9. A downhole apparatus comprising:

a plurality of casing joints defining a casing string;

a flow barrier connected in the casing string and defining a lower end of a buoyancy chamber; and a plug assembly defining an upper end of the buoyancy chamber, the plug assembly comprising:

an outer case connected in the casing string, the outer case defining a first axial flow passage in a wall thereof;

a first degradable plug having an upper surface mounted in the outer case;

a non-permeable seal positioned on the upper surface of the first degradable plug; and a rupture disk mounted in a port in a wall of the outer case, fluid in an interior of the casing string above the upper surface of the first degradable plug being communicated into an open space in the interior of the casing string below the upper surface of the first degradable plug using the port and the first axial flow passage, the fluid received in the open space below the upper surface of the first degradable plug being communicated into the interior of the casing string below the first degradable plug, the first axial flow passage having an exit opening that is unblocked both prior to and after the degrading of the first degradable plug, the outer case having a second axial flow passage defined in the wall thereof, the plug assembly comprising first and second spaced-apart degradable plugs, wherein the first axial passage communicates degrading fluid to the open space in the interior of the casing string between the first and second degradable plugs, the second axial passage configured to receive degrading fluid from the open space in the interior of the casing string between the first and second degradable plugs and to communicate the degrading fluid to the interior of the casing string below the second degradable plug.

10. The downhole apparatus of claim 9, the first and second degradable plugs comprising circular disks.

11. A downhole apparatus comprising: a plurality of casing joints defining a casing string;

a flow barrier connected in the casing string and defining a lower end of a buoyancy chamber; and a plug assembly defining an upper end of the buoyancy chamber, the plug assembly comprising:

an outer case connected in the casing string, the outer case defining a first axial flow passage in a wall thereof;

a first degradable plug having an upper surface mounted in the outer case;

a non-permeable seal positioned on the upper surface of the first degradable plug; and a rupture disk mounted in a port in a wall of the outer case, fluid in an interior of the casing string above the upper surface of the first degradable plug being communicated into an open space in the interior of the casing string below the upper surface of the first degradable plug using the port and the first axial flow passage, the fluid received in the open space below the upper surface of the first degradable plug being communicated into the interior of the casing string below the first degradable plug, the first axial flow passage having an exit opening that is unblocked both prior to and after the degrading of the first degradable plug, the first degradable plug comprising spaced-apart upper and lower cap portions and a connecting portion therebetween, the first axial passage configured to communicate fluid from the interior of the casing string above the upper cap portion to the interior of the casing string in the open space between the upper and lower cap portions, fluid from the open space between the upper and lower cap portions being communicated to the interior of the casing string below the first degradable plug through a second axial passage defined in the wall of the outer case.

12. The downhole apparatus of claim 11, the connecting portion comprising a hyperbolic hyperboloid.

13. A downhole apparatus comprising:

a plurality of casing joints defining a casing string;

a flow barrier connected in the casing string and defining a lower end of a buoyancy chamber; and a plug assembly defining an upper end of the buoyancy chamber, the plug assembly comprising:

an outer case connected in the casing string, the outer case defining a first axial flow passage in a wall thereof;

a first degradable plug having an upper surface mounted in the outer case;

a non-permeable seal positioned on the upper surface of the first degradable plug; and a rupture disk mounted in a port in a wall of the outer case, fluid in an interior of the casing string above the upper surface of the first degradable plug being communicated into an open space in the interior of the casing string below the upper surface of the first degradable plug using the port and the first axial flow passage, the fluid received in the open space below the upper surface of the first degradable plug being communicated into the interior of the casing string below the first degradable plug, the first axial flow passage having an exit opening that is unblocked both prior to and after the degrading of the first degradable plug, the first degradable plug defining a flow channel having an entry port and an exit port, wherein the first axial passage communicates fluid from the interior of the casing string above the upper surface of the first degradable plug to the interior of the casing below the first degradable plug through the flow channel, wherein the fluid entering the entry port of the flow channel exits through the exit port of the flow channel into the interior of the casing below the first degradable plug.

* * * * *